United States Patent [19]

Olah

[11] Patent Number: 5,069,051

[45] Date of Patent: Dec. 3, 1991

[54] METHOD AND APPARATUS FOR FORMING THREADS ON A SLEEVE INNER WALL

[75] Inventor: Benjamin Olah, Hacienda Heights, Calif.

[73] Assignee: California Industrial Products, Inc., Santa Fe Springs, Calif.

[21] Appl. No.: 578,466

[22] Filed: Sep. 7, 1990

[51] Int. Cl.[5] ..... B21D 53/24

[52] U.S. Cl. ..... 72/68; 10/72 R; 72/340

[58] Field of Search ..... 72/68, 340, 370, 356; 10/72 R, 75, 86 F, 87, 128, 129 R, 140, 152 T

[56] References Cited

U.S. PATENT DOCUMENTS 1,676,482 7/1928 Lapotterie ..... 10/152 T
2,749,561 6/1956 Rush ..... 10/75
3,010,126 11/1961 Willcox ..... 10/72 R
3,358,306 12/1967 Haralampiev et al. ..... 10/141 R
4,297,774 11/1981 Medlock ..... 72/340

*Primary Examiner*—Lowell A. Larson
*Attorney, Agent, or Firm*—George J. Netter

[57] ABSTRACT

A sleeve constructed of a deformable material has a bore of such diameter as to permit sliding receipt over the forming threads on the end portion of a tap and locating about a reduced diameter unthreaded portion of the tap. The tap threads are constructed to initiate forming from the inner part of the tap shank and finish at the shank end. The sleeve is compressed to conform to the tap reduced diameter portion and moved to and off the threads as the tap is rotated forming threads on the tap inner wall. Reverse rotation of the tap to remove it from the threaded sleeve is not required.

9 Claims, 3 Drawing Sheets

METHOD AND APPARATUS FOR FORMING THREADS ON A SLEEVE INNER WALL

BACKGROUND

1. Field of the Invention

The present invention relates generally to forming threads on the internal surface of a sleeve and, more particularly, to a method and apparatus amenable for use in on-line production process for forming threads on the internal surface of a deformable sleeve.

2. Description of Related Art

In the manufacturing of a great variety of small parts, a sheet or strip of metal is acted upon by a set of progressive dies which successively apply a forming operation to the metal one step of which typically includes threading one or more sleeves. The standard technique for such thread production has consisted of moving the workpiece into a threading station where an appropriately dimensioned tap is threaded in a forward direction into the sleeve to produce threads on the sleeve and then rotated in reverse direction to remove it from the threaded sleeve. The disadvantages of such a process are, first of all, the requirement for switching the direction of rotation of the tap requires additional apparatus and the time involved in removing the tap is, of course, not usefully applied. Secondly, the tap after being driven forward to produce the thread is then subjected to a redundant operation of merely removing the tap from the threaded sleeve which increases the frictional wear on the tap decreasing its useful life.

It is therefore a desideratum to provide apparatus and a method for producing threaded sleeves in a production process which is capable of effecting high volume production and reducing the disadvantages and unnecessary costs of present day known threading techniques.

SUMMARY OF THE INVENTION

In the described apparatus for practicing the method of the present invention, the tap has an elongated generally cylindrical shaft with forming threads at one end which differ from conventional tap threads in that they have their largest diameter at the shaft terminus and a smaller diameter inwardly of the shaft terminus. The shaft just behind the forming threads has a substantially smaller diameter than that of the forming threads, with the remainder of the tap shank having portions of square or hexagonal shape to be received within a conventional chuck for driving connection to an electric motor, for example.

As a fundamental preparation for the process and use of the apparatus of this invention, the sleeve to be threaded is constructed of a metal of such thickness that it can be deformed radially by compression. The sleeve also has an internal bore diameter which is larger than the outer diameter of the tap forming threads so that the unthreaded sleeve can be slid down onto the tap end and past the threads so as to be located opposite the reduced diameter portion of the tap shank. The sleeve is positioned on the upper surface of a vertically movable support plate with the tap received within the sleeve and the small diameter shank portion lying opposite the sleeve sidewall. A compression die is then moved down over the tap threads and compressingly engages the sleeve to reduce the sleeve radially to the point that the sleeve cannot slidingly be removed over the tap threads.

Next, the support plate is moved upwardly forcing the sleeve onto the tap threads while, at the same time, applying rotative motion to the tap as well as raising the compression die off the sleeve. The support plate motion is continued until the sleeve has been completely threaded and is moved off the outer end of the tap. The threaded sleeve may now be removed or transported on to a further station for additional forming operations.

In the practice of the method of this invention and use of the described apparatus, a number of decided advantages are obtained, namely, the tap always rotates in the same direction and does not need relatively expensive equipment for reversing rotation to remove the tap; the tap will automatically be lined up with the sleeve since the sleeve is fully positioned on the tap before threading begins; tap life will be increased substantially since there is no reversing wear; as an indirect result of the tap single rotation drive, inexpensive tooling can be used such as a slip in/slip out tap unit; and since reverse drive is not required the driving speed can be increased substantially resulting in a corresponding production process rate increase.

DESCRIPTION OF A PREFERRED EMBODIMENT

Figure 1:
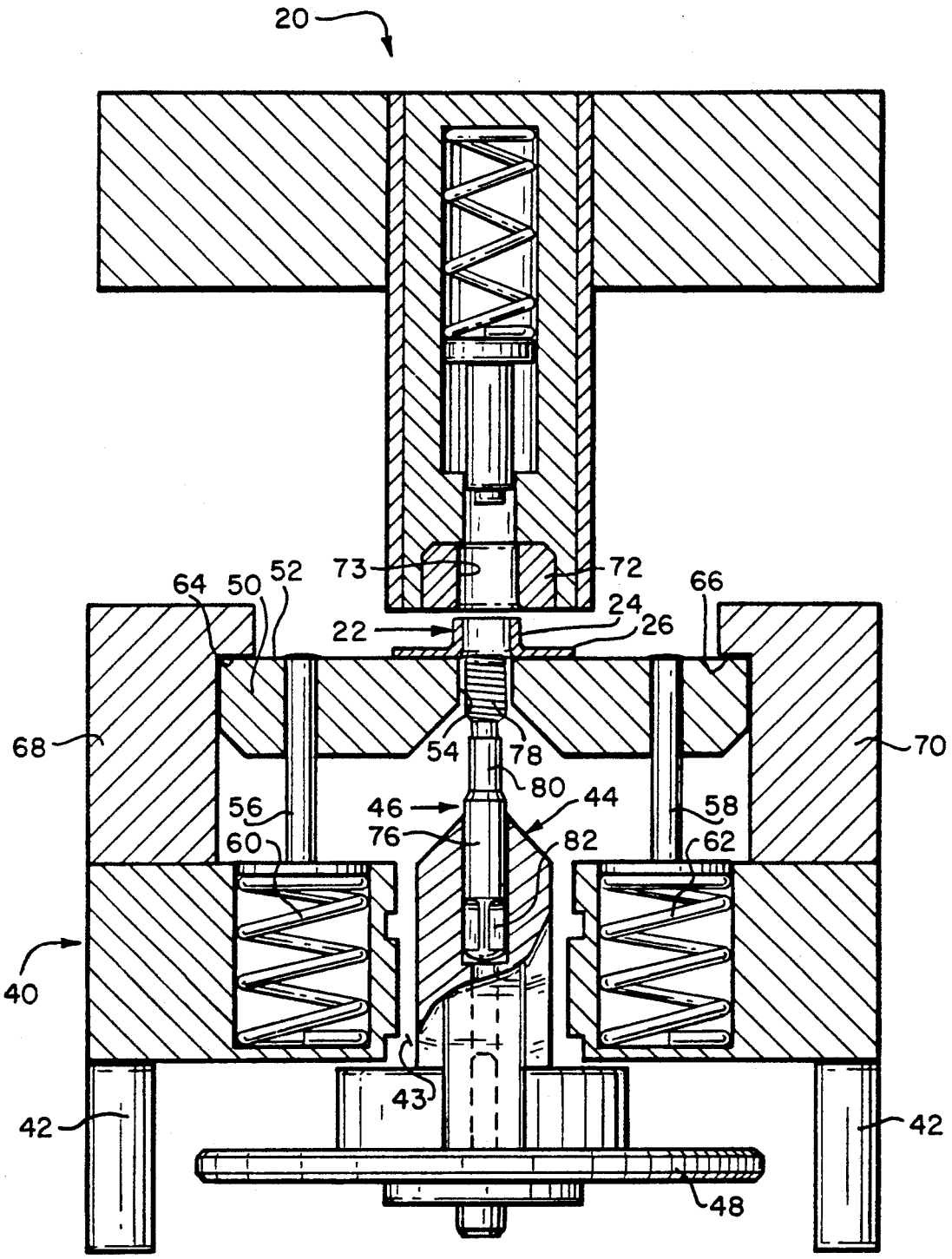
FIGS. 1, 2 and 3 show side elevational, sectional views of apparatus of the invention for threading the internal surface of a sleeve in accordance with this invention in its initial sleeve loading phase, an intermediate phase, and after threading of the sleeve, respectively.

Reference is made now to the drawings and particularly FIG. 1 thereof where there is shown in side elevational view apparatus enumerated generally as 20 for carrying out the method of the present invention to provide a thread on the internal surface of a sleeve 22. The sleeve 22 includes generally a hollow tubular portion 24 with an outwardly extending flange 26. As will be more particularly described, it is contemplated that the present invention will be most advantageously employed in threading sleeves on a continuous production process where the sleeves are formed from a flat metal sheet by a set of progressive dies.

Figure 4:
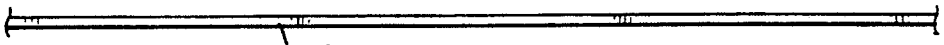
FIGS. 4–6 show a workpiece in which a sleeve is formed by a progressive die operation from a flat metal sheet to a finally threaded sleeve.
Figure 5:
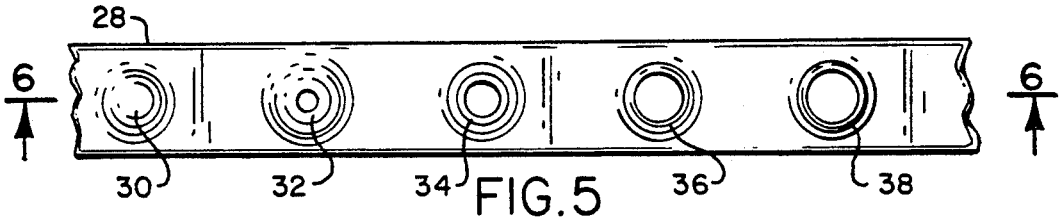
Figure 6:
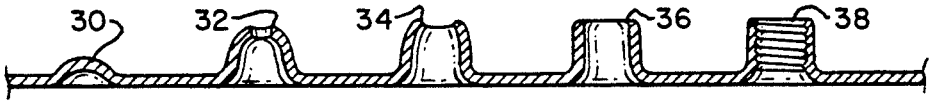
Figure 7:
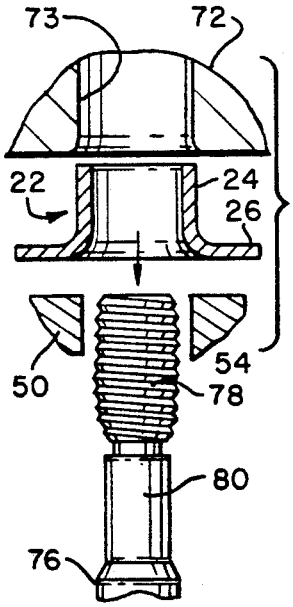
FIG. 7 shows the tapping apparatus of the invention with a preformed sleeve being added to the apparatus.

As can be best seen in FIGS. 4 through 6, the sleeve 22 is formed from a strip of metal 28 which is successively passed through a set of progressive dies (not shown) where first an imperforate bubble 30 is formed, then the bubble is extended transversely of the strip somewhat and perforated at its end as 32. The sleeve is further shaped as 34, and finally it is brought to the stage 36 where it is identical to the form of the sleeve 22 for receiving threads in accordance with this invention. The fully threaded sleeve is identified as 38 in FIG. 6 where it is shown as it would normally appear on the strip during the manufacturing process and after which it is cut from the strip for storage and use.

Returning to FIG. 1 the apparatus 20 can be seen to include a base 40 that is supported from a floor or ground level by a plurality of legs 42 and has a central opening 43 through which a chuck 44 extends upwardly and within which chuck the tap 46 of the present invention is secured in conventional manner. The chuck 44 is interconnected to a satisfactory rotational drive means (not shown) by a pulley 48, for example. The apparatus further includes a drive plate 50 which has a flat smooth upper surface 52 and includes a central opening 54 of such diameter as to enable sliding receipt over the tap 46 in spaced relation to the tap threads. A plurality of drive rods 56 and 58 are secured to the plate 50 and have their lower ends received in active contact with springs 60 and 62, respectively, resiliently urging the plate 50 to its uppermost limit as shown in FIG. 1 where the plate edges engage internal shoulders 64 and 66 on side walls 68 and 70. At the time the plate upper surface 52 engages the shoulders 64 and 66, the upper end of the tap 46 will be substantially coextensive with the surface 52 or slightly above it.

Above the drive plate 50 is a compression die 72 which is located directly opposite the opening 54 in the plate 50 and interconnected to drive means (not shown) for moving the compression die along a line toward and away from the plate 50 in a way and to an extent that will be more particularly described.

The compressive die 72 is generally disk-shaped with a central opening 73 of diameter slightly smaller than the outer diameter of the sleeve tube 24 in order to reduce the internal diameter of the sleeve tube upon compressive application thereto to a range necessary for practicing this invention as will be more particularly described.

Figure 10:
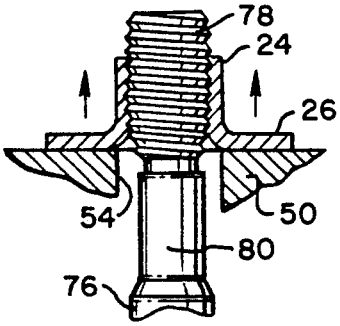
FIG. 10 depicts the preformed sleeve intermediate the formation of threads by the process of this invention.

The tap 4 is of special construction for utilization in the apparatus and for practicing the method of this invention. For the ensuing details of the tap construction, reference is simultaneously made to both FIGS. 1, 10 and 11. The tap has an elongated shank 76 at one end of which there is provided a set of forming threads 78 which, although of conventional construction, are reversed on the shank having their large diameter thread portion at the outer end of the shank and the smaller thread diameter at the inner position spaced from the shank end. Immediately adjacent the small diameter part of the forming thread 78 is a reduced diameter portion 80 of a diameter which is less than the inner diameter of the preformed sleeve 22 (or 36). The remainder of the tap shank is conventional in having a square or hexagonal end portion 82 for fitting receipt within the chuck 44.

In operation of the described apparatus to practice the method of this invention, a preformed sleeve 22 in the form and condition 36 is located directly over the opening 54 in the drive plate 50 and aligned with the tap 46.

Figure 8:
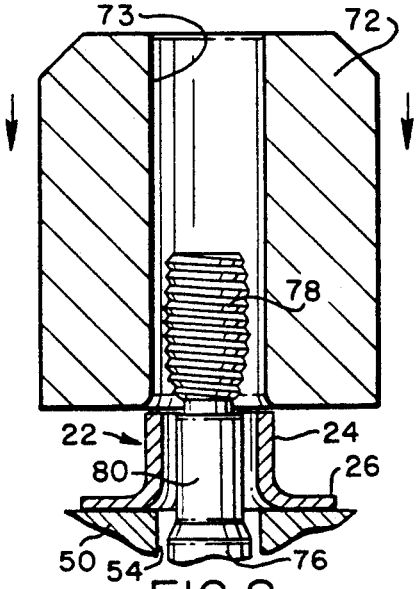
FIG. 8 shows the preformed sleeve being properly located on the tap.
Figure 9:
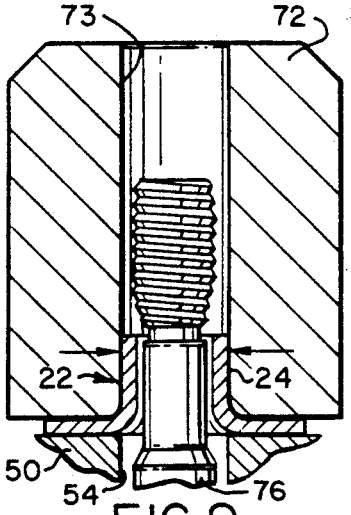
FIG. 9 shows the preformed sleeve being compressed onto the tap.

Next, the compression die 72 is driven downward so that it contacts the upper end of the sleeve tube forcing it downward against the plate 50 and, in this manner, continues driving the plate downwardly against the springs 60 and 6 until the plate is at the bottom of its throw with the sleeve tube located immediately opposite the reduced diameter portion 80 of the tap shank as shown in FIG. 8. Continued downward driving of the die now compresses the sleeve tube 24 inwardly against the outer surfaces of the reduced diameter portion 80. This compressive action is achieved since the plate can no longer move downwardly and, therefore, additional movement of the die is resisted by the sleeve resulting in reduction of the sleeve diameter. The apparatus is now in the position shown in FIG. 2.

Figure 2:
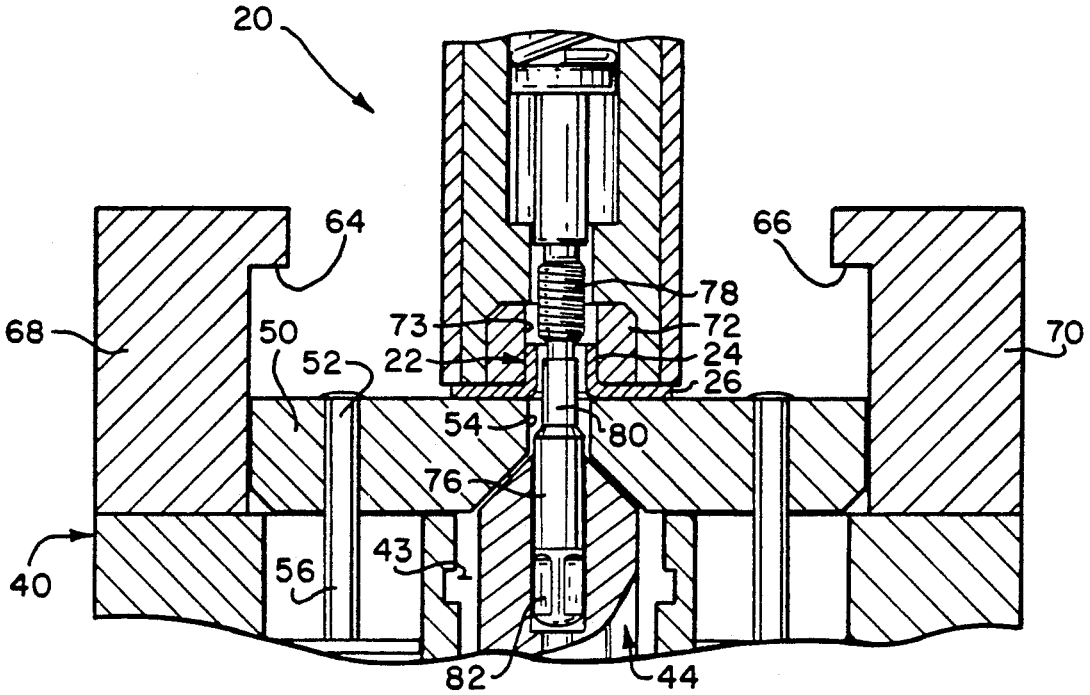
Figure 3:
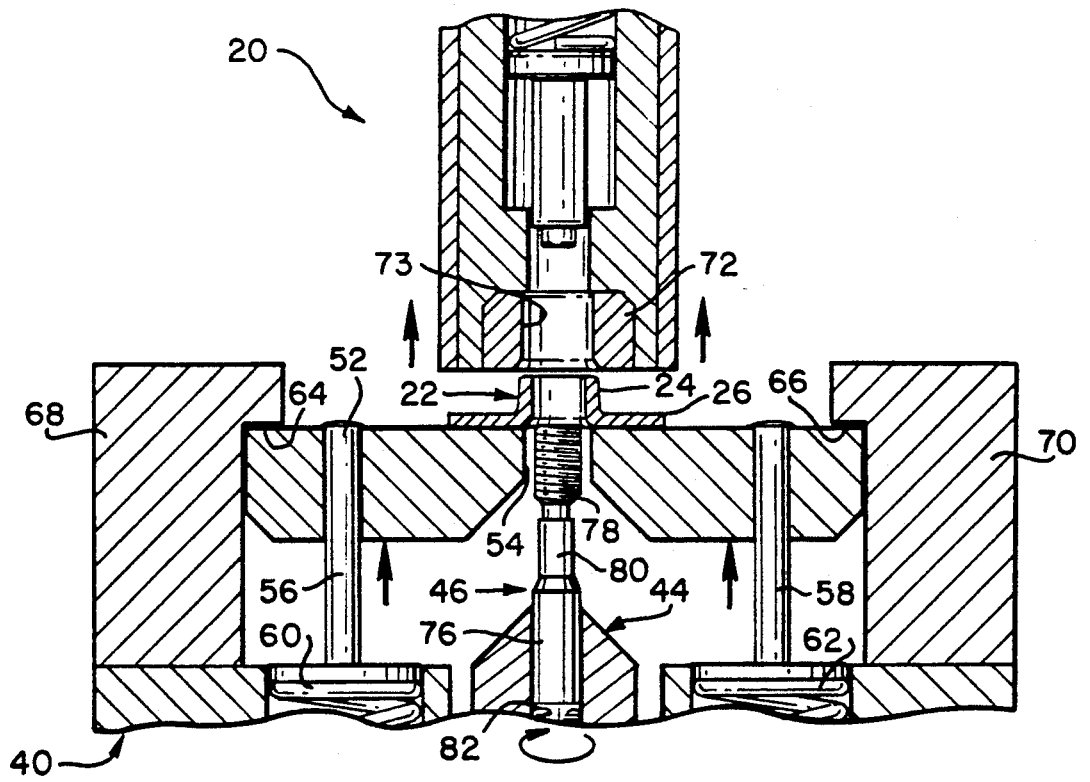
Figure 11:
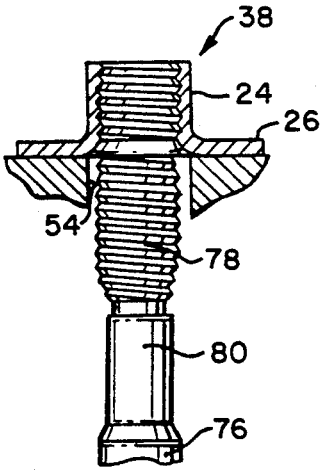
FIG. 11 shows the threaded sleeve being removed off the end of the tap.

On the apparatus reaching the position of FIG. 2, there simultaneously occurs a lifting of the die 72 upward away from the drive plate 50 and initiation of tap rotation. As an inherent result of the loaded condition of springs 60 and 62, the drive plate 50 rises forcing the sleeve 22 with its reduced tube diameter onto the tap forming threads 78 initiating thread formation on the sleeve. This combination motion continues until the sleeve tube is completely threaded by the tap and the position is reached as shown in FIGS. 3 and 11 with the threaded sleeve removed from the tap. It is to be noted that FIGS. 1 and 3 are identical for the tapping apparatus 20 except that the sleeve is now threaded and, therefore, for further operations to commence, it is necessary that the threaded sleeve be removed and replaced by a preformed but unthreaded sleeve 22.

A most important advantage of the invention is the elimination of the former requirement for driving the tap in two different directions for each threading operation, namely, in a first direction to form the threads and then in the reverse direction to remove the tap from the threaded sleeve. In the described apparatus, the tap only has to be driven in one direction which reduces tap wear, reduces the tap drive complexity and cost, and increases operation efficiency.

Although the present invention is described in connection with a preferred embodiment, it is to be understood that modification can be made thereto and still remain within the spirit of the invention and the ambit of the appended claims.

What is claimed is:

1. Method of making a threaded sleeve, comprising the steps of:

forming a sleeve having a bore of oversize diameter;

locating the sleeve on the shank of a tap behind the tap threads;

radially compressing the sleeve about the tap shank until the sleeve bore diameter is less than the tap threads outer diameter; and rotating the tap while forcing the sleeve toward the tap threads to first form threads on the sleeve and then remove the sleeve off the tap threads.

2. Method as in claim 1, in which the sleeve is formed from a metal strip by consecutively engaging the strip with a set of progressive dies.

3. Method as in claim 1, in which the sleeve is located on the tap shank by sliding the sleeve bore over the tap threads to a point just behind the threads.

4. Method as in claim 1, in which the sleeve is radially compressed by forcing a die with an opening of less diameter than the sleeve outer diameter onto a sleeve end and continuing forcing movement parallel to the sleeve bore axis.

5. Method of threading the interior wall of a hollow tubular sleeve constructed of a malleable metal, comprising the steps of:

positioning the sleeve on a thread forming tap behind the tap threads;

compressing the sleeve to a predetermined internal diameter less than that of the tap forming threads;

rotating the tap; and advancing the sleeve toward the rotating tap to first form threads on the sleeve interior wall and then move the sleeve off the tap.

6. Apparatus for providing a sleeve with a threaded bore off predetermined lesser diameter from an initially unthreaded larger diameter bore, comprising:

supporting means having an opening therein;

a tap having forming threads on an end portion and an unthreaded central portion of said predetermined diameter, said tap being located within the supporting means opening;

means for locating the sleeve about the tap central portion;

means for compressing the sleeve about the tap central portion;

means for rotating the tap; and means for moving the sleeve from the tap central portion toward and past the threads.

7. Apparatus as in claim 6, in which the compression means includes a die, and means for selectively moving the die into compressive contact with said sleeve and away from said sleeve.

8. Apparatus as in claim 7, in which the locating means includes a drive plate having an opening within which the tap is positioned, and the sleeve is located on the plate aligned with the opening; said means for moving the die also moving the sleeve on die contact to a position about the tap central portion.

9. Apparatus for providing a sleeve with a threaded internal bore of predetermined lesser diameter from an initially unthreaded larger diameter bore, comprising:

a tap having forming threads on an end portion and an unthreaded central portion of said predetermined diameter;

means for locating the sleeve about the tap central portion;

means for compressing the sleeve about the tap central portion;

means for rotating the tap; and means for moving the sleeve from the tap central portion toward and past the threads.

* * * * *